US007896699B2

(12) United States Patent
Konno et al.

(10) Patent No.: US 7,896,699 B2
(45) Date of Patent: Mar. 1, 2011

(54) INTERFACE CONNECTOR

(75) Inventors: Takeshi Konno, Tokyo (JP); Katsuhiro Hori, Tokyo (JP); Masaaki Hayashi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 12/385,420

(22) Filed: Apr. 7, 2009

(65) Prior Publication Data

US 2009/0264024 A1 Oct. 22, 2009

Related U.S. Application Data

(60) Provisional application No. 61/064,996, filed on Apr. 8, 2008.

(51) Int. Cl.
*H01R 13/648* (2006.01)

(52) U.S. Cl. ..... 439/607.35

(58) Field of Classification Search . 439/607.35–607.4, 439/83, 660
See application file for complete search history.

(56) References Cited

U.S. PATENT DOCUMENTS 4,385,795 A 5/1983 Endoh et al.
6,402,554 B1 * 6/2002 Yeh ..... 439/607.39
7,338,318 B2 * 3/2008 Shen et al. ..... 439/571

FOREIGN PATENT DOCUMENTS

WO WO 2005/043687 A1 5/2005
WO WO 2007/021299 A1 2/2007

OTHER PUBLICATIONS

Communication (including search report) in related European Patent Application No. 09 157 521.7, mailed Sep. 16, 2010.

* cited by examiner

*Primary Examiner*—Ross N Gushi
(74) *Attorney, Agent, or Firm*—The Nath Law Group; Jerald L. Meyer; Jiaxiao Zhang

(57) ABSTRACT

An interface connector makes the pitches between the contacts narrower and realizes miniaturization of the connector. This connector (100) has: a shield case (110) that includes a fitting slot (101) into which an electronic component inserted from an open side fits; a housing (120) that is covered by the shield case (110); and a plurality of contacts (140A and 140B). In the shield case (110), a plurality of contacts (140A and 140B) are disposed along the insertion direction in the housing (120) and contact point parts (141) are aligned in a row in the direction orthogonal to the insertion direction. Lead parts (144) of contacts (140A and 140B) which are adjacent in the direction orthogonal to the insertion direction, project from rear surface (104) of the connector (100), alternately in the directions orthogonal to the insertion direction and the direction in which the contact point parts are aligned in a row.

1 Claim, 3 Drawing Sheets

INTERFACE CONNECTOR

CROSS REFERENCE TO RELATED APPLICATIONS

This application claims the benefit of U.S. Provisional Patent Application No. 61/064,996, filed on Apr. 8, 2008, the disclosure of which is hereby incorporated by reference.

BACKGROUND OF THE INVENTION

1. Field of the Invention

The present invention relates to an interface connector used to connect between electronic devices such as AV (Audio Visual) equipment.

2. Description of the Related Art

It is known that some electronic devices such as portable AV equipment including digital cameras are connected with a personal computer through a cradle. To connect electronic devices through a cradle, the contacts of a plug connector for the cradle are connected with a receptacle connector of the electronic device body (hereinafter, "receptacle") and are arranged to meet the terminals of the receptacle.

Both of the receptacle and the plug to be connected generally have shield cases that fit each other, and, when the receptacle and plug fit, the shield case of the plug fits into the shield case of the receptacle.

In the receptacle, a plurality of terminals in the shield case of the receptacle are aligned orthogonal to the fitting direction in the top and bottom surfaces on a flat housing disposed in the shield case.

On the other hand, the plug, which is an interface connector to be connected with the receptacle, has a slit formed in the center portion of the housing in the shield case, and the flat housing of the receptacle is inserted in this slit. In the opposing wall parts sandwiching this slit, a plurality of contacts are arranged in a direction (i.e. longitudinal direction) orthogonal to the direction in which the contacts fits with the receptacle. A plurality of contacts arranged in the opposing wall parts are arranged to face each other across the slit, and, when the plug is inserted in the receptacle, sandwich the housing of the receptacle in the slit and are connected with the terminals of the flat housing.

These plug-side contacts are disposed in the opposing wall parts of the housing to extend along the fitting direction from contact point portions seen in the slit toward the rear surface (i.e. the end surface on the fitting direction side), are guided from the rear surface to the outside and make end parts that are bent to extend in the direction apart from the opposing contacts across the slit lead parts to be connected with patterns in a substrate.

Recently, accompanying the miniaturization of equipment to be mounted, the plug itself is miniaturized in size and there is a demand to narrow the pitches (i.e. make pitches narrower) between contacts aligned in the longitudinal direction.

However, with the plug of the above configuration, if the pitches between the contacts arranged in the opposing surfaces sandwiching the slit in the plug housing are made narrower, the pitches between the lead parts bent to extend from the rear surface of the housing are made narrower as in the contact portions of the contacts.

That is, the pitches between the lead parts which are mounting portions of the plug narrow and the plug needs to be mounted on the substrate such that touch between adjacent lead parts is prevented, and, therefore, there is a problem that mounting the connector is difficult and laborious.

SUMMARY OF THE INVENTION

It is therefore an object of the present invention to make the pitches between contacts narrower and miniaturize a connector.

To achieve the above object, an interface connector according to the present invention that fits and electrically connects with an electronic component to be inserted from an open side, employs a configuration including: a shield case into which the electronic component to be inserted from a fitting slot fits; a housing which is covered by the shield case; a plurality of contacts which are arranged along an insertion direction in the housing and which are aligned in a row in a direction orthogonal to the insertion direction, wherein: the plurality of contacts comprise: contact point parts which are connected with a plurality of terminals of the inserted electronic component; and lead parts which are formed continuing from the contact point parts and which project from an outer surface part of the housing on an insertion direction side to outside; and the lead parts of the contacts which are adjacent in the direction orthogonal to the insertion direction project from the outer surface part alternately in directions orthogonal to the insertion direction and the direction in which the contacts are aligned in a row.

DETAILED DESCRIPTION OF THE PREFERRED EMBODIMENT

Figure 1:
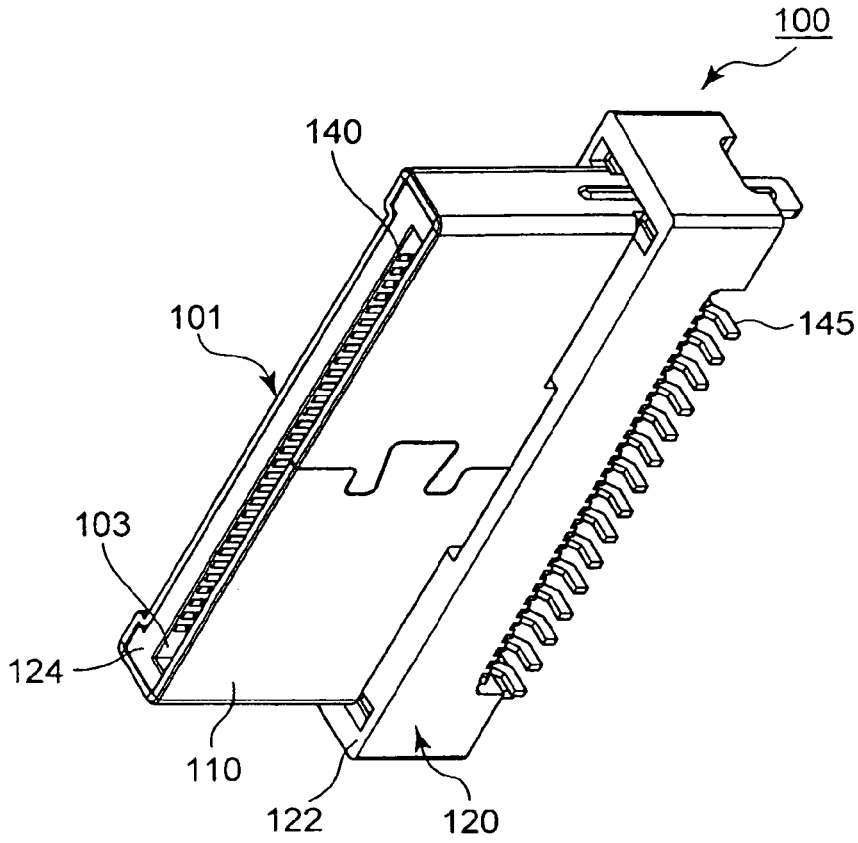
FIG. 1 is a perspective view of a connector according to an embodiment of the present invention.
Figure 2:
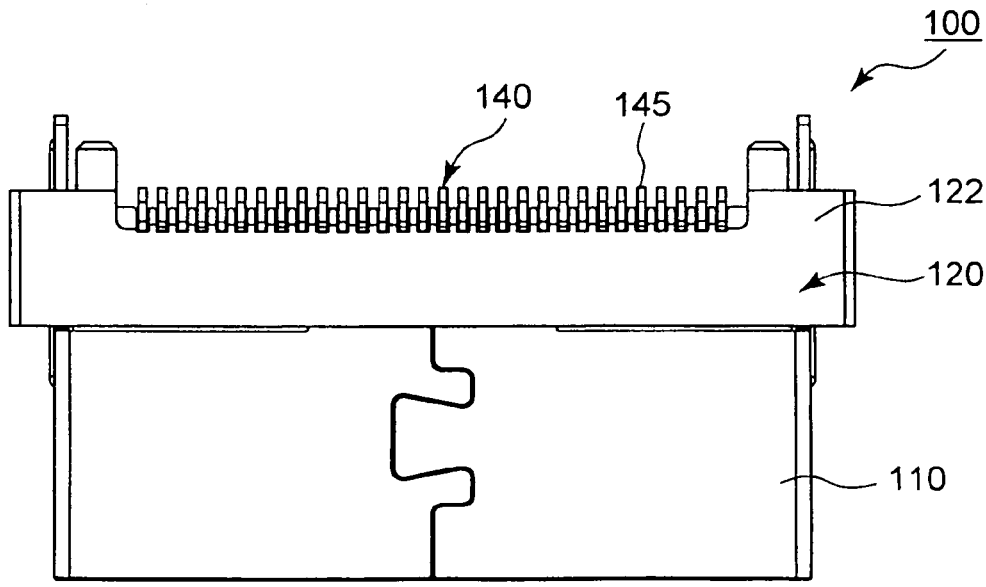
FIG. 2 is a bottom view of the connector according to an embodiment of the present invention.

Hereinafter, an embodiment of the present invention will be explained in detail with reference to the accompanying drawings. FIG. 1 is a perspective view of a connector according to an embodiment of the present invention and FIG. 2 is a bottom view of the connector according to an embodiment of the present invention. Further, FIG. 3 is a front view of the connector according to an embodiment of the present invention and FIG. 4 is a rear view of the connector according to an embodiment of the present invention.

The connector shown in FIG. 1 to FIG. 4 is plug connector 100 that is connected when the receptacle connector is inserted. Further, the receptacle connector which is the target to connect with has a flat housing and a plurality of terminals aligned in at least one of the top and bottom surfaces of the housing in the direction orthogonal to the direction in which plug connector 100 is inserted, to be more specific, aligned in the width direction in one of the surfaces of the flat housing. Plug connector 100 will be explained here as a connector for a cradle.

Figure 3:
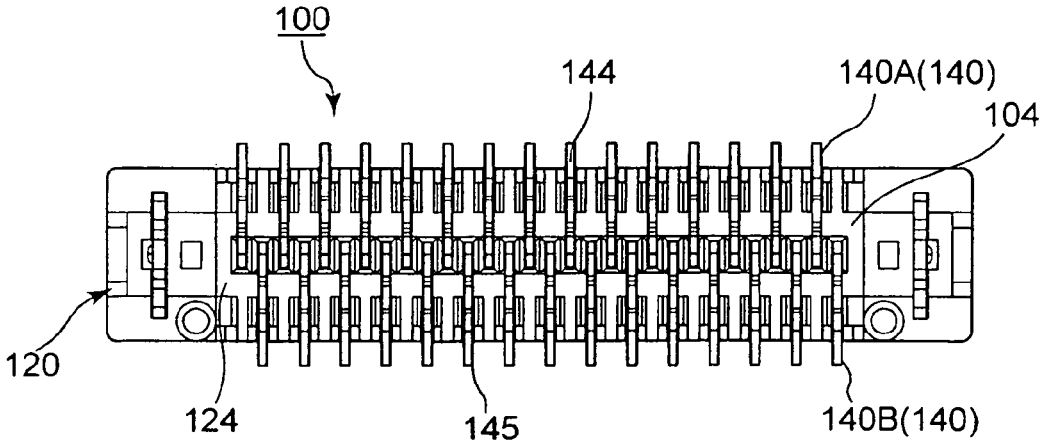
FIG. 3 is a front view of the connector according to an embodiment of the present invention.
Figure 4:
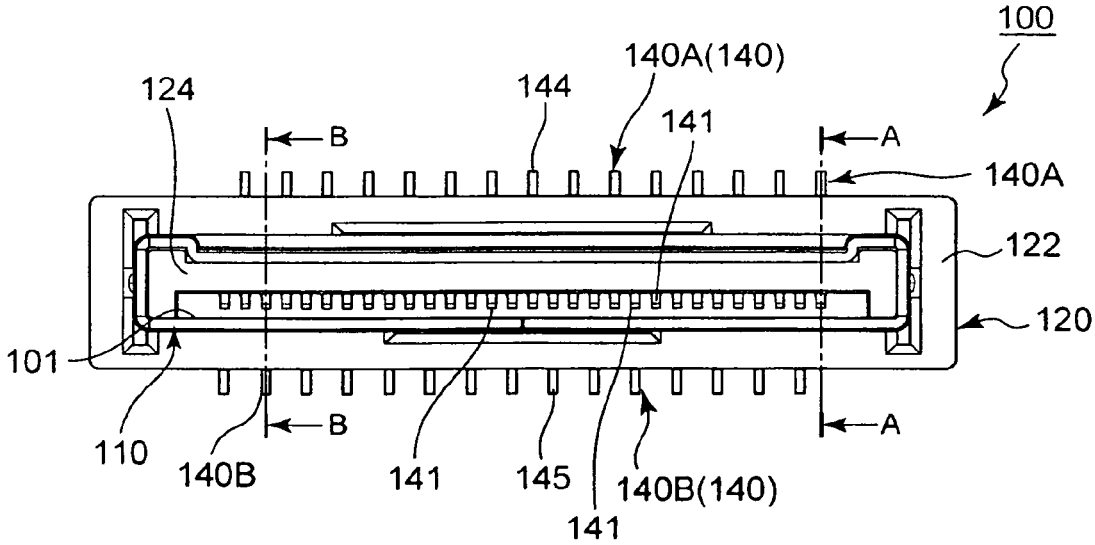
FIG. 4 is side back view of the connector according to an embodiment of the present invention.

Plug connector 100 has: shield case 110; housing 120 in which virtually flat projecting part 124 projecting from the front surface of virtually rectangular parallelepiped base part 122 is covered by shield case 110; and a plurality of contacts 140 disposed in housing 120 (140A and 140B shown in FIG. 3 and FIG. 4).

In plug connector 100, shield case 110 and projecting part 124 form fitting slot 101 that is open on the front surface side. To be more specific, in projecting part 124, the front end part side is made hollow and a notch in a trench shape is made such that the lower surface side of front end part 124*a* (see FIG. 5) is open downward. This notch part and the lower surface part of shield case 110 form fitting slot 101 and insertion space 103 communicating with fitting slot 101. The flat portion of the housing of the receptacle, which is the target to connect with, is inserted in this insertion space 103 through fitting slot 101.

As shown in FIG. 3, contact point parts 141 aligned in a row in the horizontal direction (i.e. width direction) orthogonal to the fitting direction of the receptacle such that contacts 140 (140A and 140B) are seen in fitting slot 101. Further, the positions of contact point parts 141 of these contacts 140 meet the positions of the terminals of the receptacle, which is the target to connect with.

These contacts 140 (140A and 140B) are aligned in a row along the longitudinal direction of fitting slot 101 in housing 120, that is, along the horizontal direction of housing 120, and contacts 140 (140A and 140B) extend in the fitting direction orthogonal to the longitudinal direction. Further, with contacts 140A and 140B of these contacts 140, which are adjacent in the longitudinal direction, lead parts 144 and 145 project upward and downward, alternately, from housing 120 as shown in FIG. 3 and FIG. 4.

Figure 5:
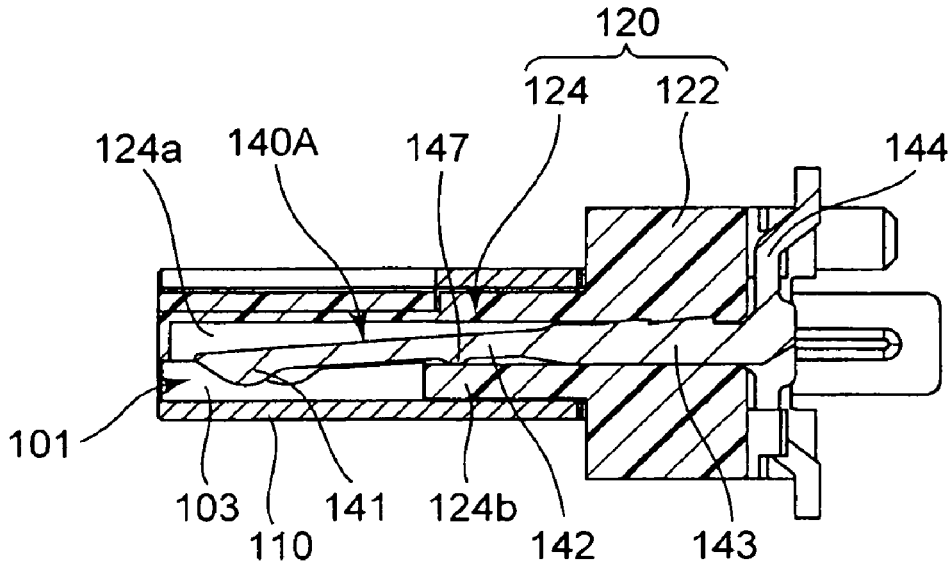
FIG. 5 is an A-A line cross-sectional view of FIG. 3 seen from the direction of an arrow.
Figure 6:
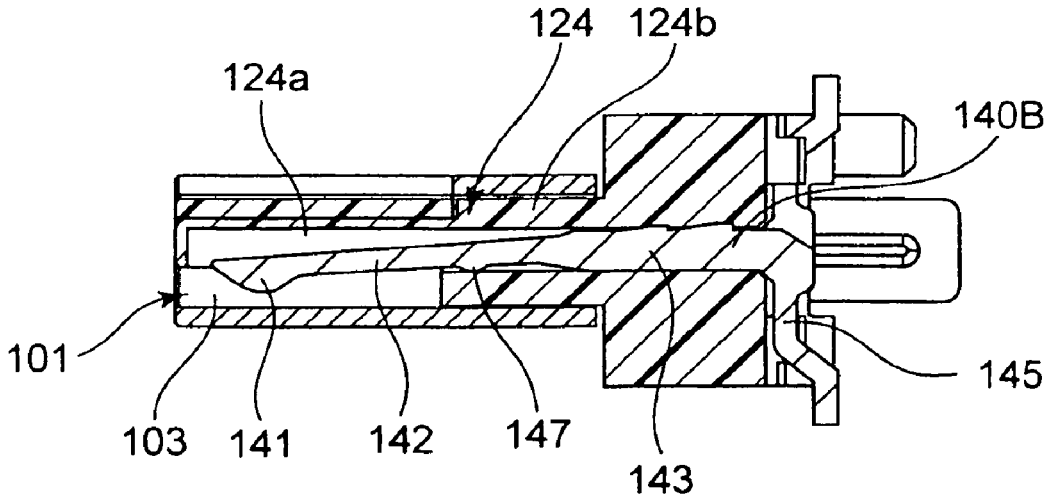
FIG. 6 is a B-B line cross-sectional view of FIG. 3 seen from the direction of an arrow.

FIG. 5 is an A-A line cross-sectional view of FIG. 3 seen from the direction of the arrow and FIG. 6 is a B-B line cross-sectional view of FIG. 3 seen in the direction from the arrow.

To be more specific, as shown in FIG. 5 and FIG. 6, in housing 120 in which contacts 140 are attached, contacts 140 are consisted of contacts 140A and 140B that direct the orientations of lead parts 144 and 145 to opposing directions which are virtually orthogonal to the fitting direction (i.e. the direction in which contacts 140 extend).

Contacts 140A shown in FIG. 5 are formed in a virtually L-shape by bending an electrically conductive linear member, and is formed in an L-shape which is linear from a plan view and which includes a predetermined width. Contact 140A has: fixed thin flat part 143 that is fixed to base part 122 and that extends in the fitting direction; elastic arm part 142 (hereinafter, "arm part") that extends from one end of fixed thin flat part 143 toward the fitting slot 101 side and that deforms elastically; contact point part 141 that is formed in the tip portion of arm part 142 and that is exposed in insertion space 103; and lead part 144 that continues from the other end of fixed thin flat part 143 and that is arranged along rear surface 104 of base part 122 to bend outside base part 122.

With contact 140A, contact point part 141, arm part 142 and fixed thin flat part 143 are successively arranged straight along the fitting direction, and lead part 144 is connected with the other end of fixed strip part 143 to be orthogonal to contact point part 141, arm part 142 and fixed thin flat part 143. Contacts 140A and contacts 140B may be formed in any way as long as they are electrically conductive and are formed in a linear shape of a virtually L-shape. Here, contacts 140A and contacts 140B are formed in a thin flat material of an L-shape from a plan view by machining an electrically conductive metal plate, such that the plate-thickness direction of the metal plate matches the width direction of plug connector 100.

Further, arm part 142 is arranged in shield case 110 to incline from one surface side (here, the upper surface side) that defines insertion space 103 to the other surface side (here, the bottom surface side) and extend toward the fitting slot 101 side. To be more specific, in shield case 110, arm part 142 projects from the base part 122 side, passes base part 124*b* of projecting part 124 and places the front end side in tip end part 124*a* of projecting part 124. Arm part 142 is arranged swingably in the vertical direction in projecting part 124 and positions the tip end side of arm part 142 in insertion slot 103.

With this arm part 142, convex part 147 is formed to project from the end part (i.e. lower side part) on the other surface side (here, the bottom surface) that defines insertion space 103. When this convex part 147 is inserted in a fixed hole formed in base end part 124*b* of projecting part 124, this convex part 147 abuts on the inner surface in the fixed hole and urges arm part 142 to be pressurized. Convex part 147 can displace the tip end part of arm part 142 in the direction opposite to the inclining direction by pressurizing arm part 142 in the opposite direction to the direction for urging arm part 142, so that contact point part 141 provided at the tip end of arm part 142 is positioned in a predetermined position in shield case 110. By this means, it is possible to position contact point part 141 in shield case 110 readily and prevent contacts from collapsing and touching adjacent contacts.

Further, contact point part 141 of contact 140 is provided at the tip end of arm part 142 extending from fixed thin flat part 143 fixed in based part 122 of housing 120 toward the fitting slot 101 side. Consequently, elastic arm part 142 is displaced, so that contact point part 141 is able to enter and leave insertion space 103 in shield case 110 from inside base end part 124*b* of projecting part 124. Contact point part 141 is arranged in insertion space 103 in a state where the receptacle connector is not connected.

Contact 140B shown in FIG. 6 has the same basic configuration as in contact 140A except that the orientation of lead part 145 is different. Therefore, the same reference numerals will be assigned and explanation thereof will be omitted.

With contact 140B, convex part 127 formed as in contact 140A positions contact point part 141 provided at the tip end of arm part 142 in a predetermined position in shield case 110. By this means, contact point part 141 of contact 140B and contact point part 141 of contact 140A are aligned in a row in the horizontal direction at the same height level.

In this way, contact 140 is formed in a virtually L-shape by contact point part 141, arm part 142 and lead part 144, and disposes the base end side (fixed thin flat part 142) of the long thin flat portion including contact point part 141 and arm part 142, along the fitting direction in base part 122 of housing 120. Further, contact point part 141 at the tip end of the long thin flat portion is a free end projecting from projecting part 124 which projects from base part 122 in shield case 110, and contact point parts 141 of connectors 140A and 140B are arranged such that the contact point positions in shield case 110 are at the same height level.

Further, contacts 140A and 140B in plug connector 100 are arranged one by one in turn in the direction orthogonal to the fitting direction, and lead parts 144 and 145 are provided alternately to extend in the thickness direction of the connector in the rear surface of base part 122, that is, in rear surface 104 (see FIG. 4) of plug connector 100. In other words, contacts 140A and 140B extend lead parts 144 alternately in parting directions from each other that are orthogonal to the insertion direction (i.e. fitting direction) upon connection with the receptacle, which is the target to connect with.

That is, with plug connector 100, a plurality of contacts 140 (140A and 140B) are aligned in a row in a direction orthogonal to the insertion direction in projecting part that defines one inner surface in the longitudinal direction of fitting slot 101 in shield case 110. By this means, contact point parts 141 of contacts 140 are seen in fitting slot 101 and are connected with terminals on a plane of a flat portion in the housing of the receptacle to be inserted in fitting slot 101. Further, in a plurality of contacts 140 (140A and 140B), lead parts 144 and 145 of contacts 140A and 140B, which are adjacent in the direction orthogonal to the insertion direction, project alternately from rear surface 104 in directions orthogonal to (both) the insertion direction and the direction in which the contacts are aligned in a row.

In other words, thanks to contacts 140A and 140B, plug connector 100 has a function of sandwiching target terminals to be connected in the liner portion when seen from the front view and electrically connecting with the terminals alternately in different directions in the liner portion.

By this means, when the pitches between contacts 140 aligned in the horizontal direction in fitting slot 101 are narrowed (made narrower), the pitches between lead parts 144 and 145 of adjacent contacts 140 in the horizontal direction, that is, the pitches between the members to be mounted, do not match the pitches between contact point parts 141 and do not narrow.

That is, as shown in FIG. 3 and FIG. 4, with contacts 140, the pitches between contact point parts 141 that are spaced apart in the longitudinal direction (i.e. horizontal direction) of fitting slot 101 in the fitting slot 101 plane and the pitches between lead parts 144 and 145 which are the mounting portions, are different, so that it is possible to make narrow the pitches between the contact point parts of contacts in the fitting slot plane without changing the pitches between lead parts 144 and 145. Consequently, in a state where a scheme for aligning contacts in a row in the horizontal direction is used, even when the pitches between contacts each including the contact point are narrowed, the pitches between the leads of the contacts projecting alternately from the upper surface of housing 120, from the front view, are not narrowed in the horizontal direction. Consequently, mounting connector 100 on the substrate through lead parts 144 and 145 does not make the mounting operation difficult and is possible at ease without labor.

Further, two types of contacts 140A and 140B to be connected with terminals in one surface side of the flat portion of the receptacle to be inserted, are aligned alternately in the horizontal direction in housing 120, such that lead parts 144 and 145 are projected zig-zag from base part 122 of housing 120. By this means, apart from the conventional configuration of the plug, the flat portion of the housing of the receptacle inserted in the slit needs not to be sandwiched between both surface sides, so that it is possible to make thinner the thickness of the fitting portion of the plug which corresponds to the thickness required to dispose contacts on one of sides sandwiching the slit.

Consequently, plug connector 100 makes it possible to miniaturize the plug connector in which the pitches between contacts 140 are made narrower.

Further, although the configuration of plug connector 100 according to the present embodiment is for a connector for the cradle, the present invention is not limited to this and is applicable to any connector as long as it is an interface connector. Further, the contacts of the receptacle connector may be arranged as in an arrangement of contacts 140 in plug connector 100. That is, as long as an interface has contacts that align contact points which touch terminals of the connection target, the present invention is applicable to any interface and is also applicable to both a plug and receptacle.

What is claimed is:

1. An interface connector that fits and electrically connects with an electronic component to be inserted from an open side, the interface connector comprising:

a shield case into which the electronic component to be inserted from a fitting slot fits;

a housing which is covered by the shield case; and a plurality of contacts which are aligned in a direction orthogonal to an insertion direction in the housing inside the shield case, wherein:

the plurality of contacts each comprise:

an elastic arm part at a tip portion of which a contact point part connected with each of a plurality of terminals in the inserted electronic component is provided and which extends along the insertion direction; and a lead part which is formed continuing from a base end side of the elastic arm part and which projects outside from an outer surface part of a depth side that is an insertion direction side of the housing;

the contact point part and the elastic arm part are each formed in same shapes between the plurality of contacts, and are aligned in a row, facing a same direction inside the housing;

each lead part of the plurality of contacts projects from the outer surface part, alternately in a direction orthogonal to both the insertion direction and the direction in which the contacts are aligned in a row, and in a direction opposite to a direction in which lead parts of contacts adjacent in the direction in which the contacts are aligned in a row project;

the elastic arm part is arranged inclining toward the contact point part inside the housing; and at an end part of an inclining direction side of the elastic arm part, a convex part projecting in the inclining direction is formed.

* * * * *